US006376146B1

(12) United States Patent
Ieda

(10) Patent No.: US 6,376,146 B1
(45) Date of Patent: Apr. 23, 2002

(54) DEVELOPING AGENT AND IMAGE FORMING APPARATUS

(75) Inventor: Osamu Ieda, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/599,546

(22) Filed: Jun. 23, 2000

(51) Int. Cl.[7] ..... G03G 9/083

(52) U.S. Cl. ..... 430/106.3; 430/108.3; 430/126

(58) Field of Search ..... 430/106.3, 108.8, 430/126, 108.3

(56) References Cited

U.S. PATENT DOCUMENTS 5,053,305 A * 10/1991 Aoki et al. ..... 430/122

6,258,501 B1 * 7/2001 Wada ..... 430/122

FOREIGN PATENT DOCUMENTS

| | | |
|---|---|---|
| JP | 2-37363 | 2/1990 |
| JP | 2-287363 | 11/1990 |
| JP | 3-256052 | 11/1991 |

* cited by examiner

*Primary Examiner*—John Goodrow
(74) *Attorney, Agent, or Firm*—Foley & Lardner

(57) ABSTRACT

Added to magnetic toner particles are 0.5 to 5% by weight based on the total weight of the toner particles of a magnetic powder and 0.01 to 0.5% by weight based on the total weight of the toner particles of stearate particles having an average particle diameter of 1 $\mu$m to 5 $\mu$m.

12 Claims, 1 Drawing Sheet

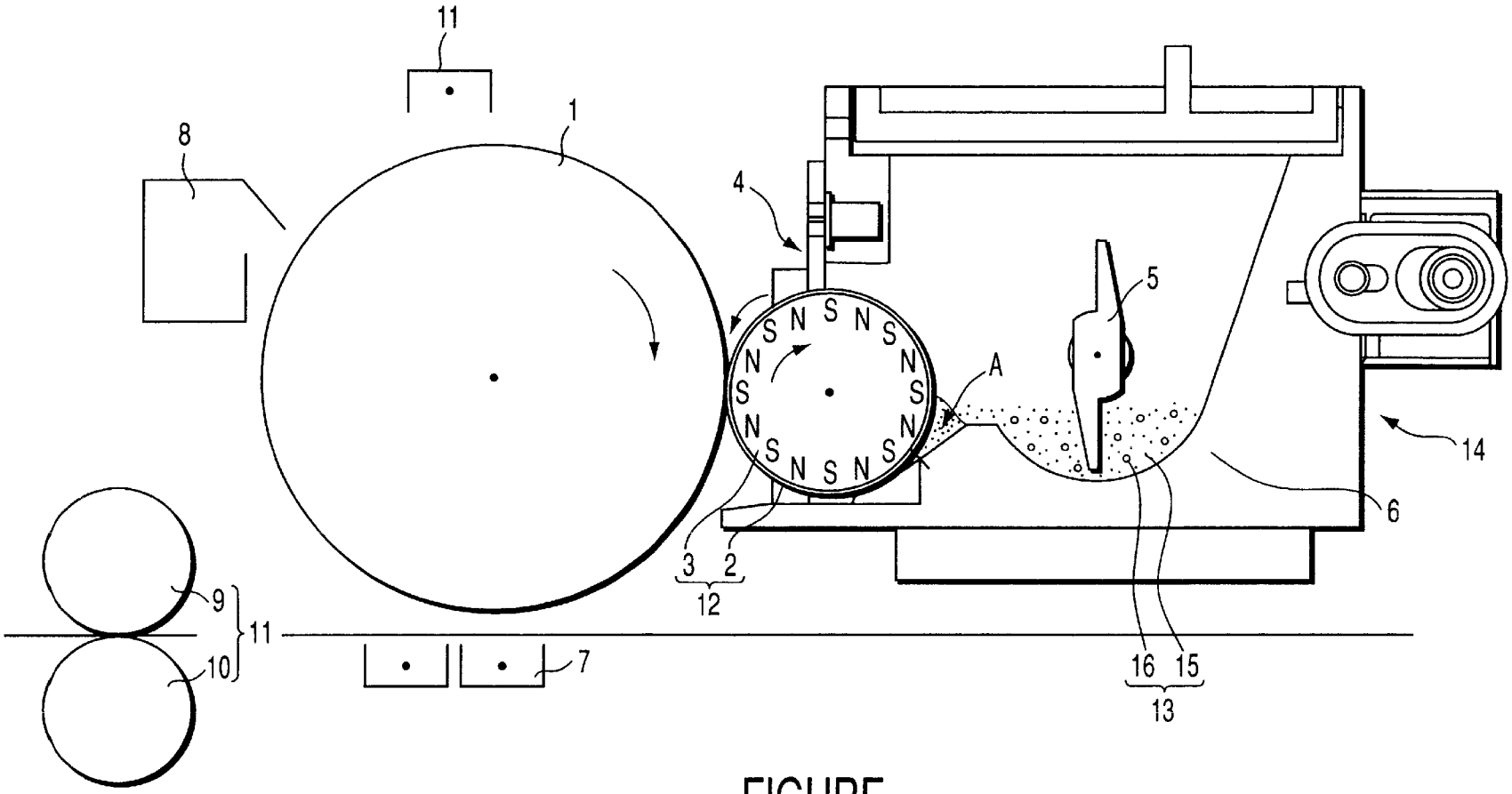
FIGURE

DEVELOPING AGENT AND IMAGE FORMING APPARATUS

BACKGROUND OF THE INVENTION

The present invention relates to an image forming apparatus such as an electrophotographic apparatus or an electrostatic recording apparatus and to a developing agent used in the image forming apparatus, particularly, to an image forming apparatus in which the development is performed by a magnet rotation developing system and a two-component developing agent used in the image forming apparatus, said developing agent containing a magnetic toner and a carrier.

In an image forming apparatus using a magnet rotation developing system, the developing roller is arranged to face an image carrier bearing an electrostatic latent image. The developing roller comprises, for example, a hollow cylindrical sleeve made of a magnetic material and arranged rotatable and a magnetic roll arranged within the sleeve, consisting of a plurality magnetic poles and rotatable independently of the sleeve.

In the magnet rotation developing system, a two-component developing agent consisting of a magnetic carrier and a magnetic toner having a magnetic material added to the surface of a magnetic toner particle is applied to the developing roll. Also, the magnetic roll and the sleeve are rotated in the same direction or opposite direction so as to transfer the developing agent into the developing region while rotating the developing agent about its own axis. In such a magnet rotation developing system, the specific concentration of the toner can be controlled easily, compared with the ordinary magnet fixation developing system. Therefore, the specific concentration of the toner can be increased in the magnet rotation developing system. It follows that the toner transfer amount is increased so as to improve the developing efficiency.

Where the magnet roll and the sleeve are rotated in the same direction, the rotating direction of the developing agent about its own axis is opposite to the transfer direction of the developing agent. On the other hand, where the magnet roll and the sleeve are rotated in the opposite directions, the rotating direction of the developing agent about its own axis is equal to the transfer direction of the developing agent so as to increase the transfer amount of the developing agent. Therefore, the rotation of the magnet roll and the sleeve in the opposite directions is adapted to the development at a high speed.

In general, in the two-component development of the magnet fixation developing system, the specific concentration of the toner on the developing roll is about 6% by weight. In the two-component development of the magnet rotation developing system, however, the specific concentration of the toner on the developing roll is maintained at about 50% by weight, leading to a merit that a so-called "carrier attachment", i.e., the phenomenon that the carrier on the developing roll is attached to the image carrier, is less likely to take place.

A developing agent that can be used in the two-component development of such a magnet rotation developing system is disclosed in, for example, Japanese Patent Disclosure (Kokai) No. 3-256052. Disclosed in this prior art is a developing agent containing a magnetic toner particle, a magnetic powder added to the magnetic particle, and a carrier. It is specified that the product among the true specific gravity, the average particle diameter and the magnetization of the carrier is greater than the product among the true specific gravity, the average particle diameter and the magnetization of the magnetic toner.

In the developing agent disclosed in this prior art, however, the surface of the photoreceptor is unduly scraped off by the magnetic powder mixed and attached to the magnetic toner particle. As a result, the sensitivity of the photoreceptor is deteriorated, resulting in failure to provide a stable charging and in a shortened life of the photoreceptor.

On the other hand, in the case of using a toner having such a magnetic powder removed therefrom, the conventional magnetic carrier fails to be charged sufficiently under a high temperature and a high humidity, resulting in decrease in the image concentration. Also, in the case of using a magnetic carrier having a high charging capability, the charging capability of the toner is rendered unduly high, resulting in an inconvenience that the image density is lowered in the case where the printing is carried out continuously. Further, in the case of using a magnetic carrier having a high charging capability, the margins in terms of the electrical resistance and the magnetic force are small, making the optimization difficult.

BRIEF SUMMARY OF THE INVENTION

A first object of the present invention, which has been achieved in view of the situation described above, is to provide a developing agent, which permits adjusting the scraping of the image carrier caused by the presence of the magnetic powder, which is satisfactory in its cleaning properties, and which permits forming a satisfactory image free from blurring and fogging through the entire life of the developing agent.

A second object of the present invention is to provide an image forming apparatus, which permits adjusting the scraping of the image carrier caused by the presence of the magnetic powder, which is satisfactory in its cleaning properties, and which permits forming a satisfactory image free from blurring and fogging through the entire life of the developing agent.

Further, a third object of the present invention is provide an image forming method, which permits adjusting the scraping of the image carrier caused by the presence of the magnetic powder, which is satisfactory in its cleaning properties, and which permits obtaining a satisfactory image free from blurring and fogging through the entire life of the developing agent.

According to a first aspect of the present invention, there is provided a developing agent comprising toner particles containing a first magnetic powder and a binder resin, 0.5 to 5% by weight based on the total weight of the toner particles of a second magnetic powder, and 0.01 to 0.5% by weight based on the total weight of the toner particles of stearate particles having an average particle diameter of 1 $\mu$m to 5 $\mu$m.

According to a second aspect of the present invention, there is provided an image forming apparatus, comprising:

at least one image carrier;

a developing device housing a toner having toner particles containing a first magnetic powder and a binder resin, 0.5 to 5% by weight based on the total weight of the toner particles of a second magnetic powder, and 0.01 to 0.5% by weight based on the total weight of the toner particles of stearate particles having an average particle diameter of 1 $\mu$m to 5 $\mu$m, including a developing roller having a hollow cylindrical sleeve arranged rotatable and a magnet roll arranged within the sleeve, rotatable independently of the sleeve and having a plurality of magnetic poles, and serving to develop an electrostatic latent image formed on the image carrier so as to form a developing agent image;

a transfer device for transferring the developing agent image;

a cleaning device for cleaning the developing agent that was not transferred; and a fixing device arranged below the transfer device for fixing the transferred developing agent image.

According to a third aspect of the present invention, there is provided an image forming method, comprising the steps of:

supplying a developing agent containing toner particles having a first magnetic powder and a binder, 0.5 to 5% by weight based on the total weight of the toner particles of a second magnetic powder and 0.01 to 0.5% based on the total weight of the toner particles of stearate particles having an average particle diameter of 1 μm to 5 μm onto a developing roller arranged to face an image carrier and having a hollow cylindrical sleeve rotatable in synchronism with the image carrier and a magnet roll having a plurality of magnetic poles and rotated independently of the sleeve so as to develop an electrostatic latent image formed on the image carrier to form a developing agent image;

transferring the developing agent image onto a transfer material; and fixing the transferred developing agent image.

According to the present invention, it is possible to form an image satisfactory in cleaning properties, free from blurring of image and fogging over the entire life of the image, and high in image density and a resolution.

BRIEF DESCRIPTION OF THE SEVERAL VIEWS OF THE DRAWING

FIGURE accompanying the present specification schematically shows the construction of an image forming apparatus according to one embodiment of the present invention.

DETAILED DESCRIPTION OF THE INVENTION

The present invention provides a developing agent comprising a toner particle containing a first magnetic powder and a binder resin, a second magnetic powder mixed with the toner particle in an amount of 0.5 to 5% by weight based on the total weight of the toner particle, and a stearate particle having an average particle diameter of 1 μm to 5 μm. The stearate particle is added in an amount of 0.01 to 0.5% by weight based on the total weight of the toner particle.

According to the present invention, a predetermined amount of a magnetic powder and a predetermined amount of a stearate particle having a predetermined particle diameter are added to the magnetic toner particle. As a result, it is possible to adjust the scraping of the image carrier caused by the magnetic powder remaining on the image carrier in the image forming step. It should also be noted that the presence of a suitable amount of the magnetic powder serves to stabilize the rising of the charging properties and the flowability of the developing agent so as to improve the image density and the level of the resolution.

If the image carrier is used repeatedly, the toner that has not been transferred onto a paper sheet and the additive to the toner remain on the image carrier. Therefore, it is desirable for the surface of the image carrier to be scraped appropriately so as to maintain a surface to which the residual toner or the like is not attached to form a surface state stable in the surface irregularity. If the scraping is insufficient, a reaction product such as an ozone product is attached to the image carrier so as to cause blurring of the image. On the other hand, if the surface of the image carrier is scraped excessively or non-uniformly, the surface state of the image carrier and the cleaning properties are rendered poor.

On the other hand, in the case of using the developing agent of the present invention for the image formation, the cleaning properties are improved so as to suppress deterioration in the residual amount of the toner cartridge accompanying the deterioration of the toner flowability and deterioration of the manufacturing properties, thereby making it possible to obtain a satisfactory image high in image density and resolution over the entire life of the developing agent.

Also, in order to control appropriately the scraping of the image carrier caused by the residual developing agent, it is desirable to use an image carrier having a scratch depth of 0.1 to 5 μm when a load of 160 g is applied to a sapphire needle having a needle curvature of 3 mm in a scratch resistant scratch test in combination with the developing agent of the present invention.

Where an image carrier having such a scratch resistance is used in combination with the developing agent of the present invention, it is possible to control more appropriately the scraping of the image carrier, making it possible to obtain a more improved image.

The present invention is adapted particularly to the technology for performing the development of a magnet rotation developing system.

The magnetic toner particle used in the present invention contains a first magnetic powder and a binder resin.

It is desirable for the magnetic toner particle to have an average particle diameter of 5 to 20 μm. For measuring the toner particle diameter, the volume particle diameter of the measured value can be calculated by the Coulter Counter method, and a 50% average particle diameter is regarded as an average particle diameter. Also, Isoton II can be used as an electrolyte in the measuring step.

The first magnetic powder can be used as a magnetic body and as a coloring material. It is desirable for the first magnetic powder to be contained in an amount of 40 to 65% by weight based on the total weight of the toner particle.

It is desirable for the first magnetic powder to have an average particle diameter of 0.1 to 1 μm. Further, a second magnetic powder and a stearate are mixed with and added to the magnetic toner particle.

The second magnetic powder is contained in an amount of 0.5 to 5% by weight based on the total weight of the toner particle. More desirably, the second magnetic powder should be contained in an amount of 0.5 to 5% by weight based on the total weight of the toner particle.

If the content of the second magnetic powder is lower than 0.5% by weight, it is impossible to obtain a stable image density and a stable resolution. If the content of the second magnetic powder exceeds 5% by weight, however, the scraping amount of the surface of the image carrier is increased so as make the cleaning properties and the toner flowability poor, resulting in decrease in the life properties and increase in the residual amount of the cartridge and in poor manufacturing properties.

The stearate used in the present invention should have an average particle diameter of 0.1 to 5 μm, preferably 1 to 5

μm. Also, the stearate should be added in an amount of 0.01 to 0.5% by weight, preferably 0.01 to 0.2% by weight, based on the total weight of the toner particle.

If the average particle diameter of the stearate particle is less than 5 μm, the fogging and cleaning properties are improved. If the stearate is added in a suitable amount, the scraping amount of the image carrier is lowered. On the other hand, if the average particle diameter of the stearate particle exceeds 5 μm, the fogging and cleaning properties are rendered poor.

It is desirable for the second magnetic powder to have an average particle diameter of 0.01 to 7 μm.

It is possible to use as the first and second magnetic powders the conventional magnetic materials such as metals including iron, manganese, cobalt, nickel and chromium and alloys thereof and metal oxides including chromium oxide, iron sesquioxide, and iron tritetraoxide. Preferably, a magnetite such as $Fe_3O_4$ should be used as the first and second magnetic powder.

It is possible for the first and second magnetic powders to be equal to or different from each other in the composition, particle diameter, etc.

The stearate used in the present invention include, for example, zinc stearate, aluminum stearate, calcium stearate and copper stearate.

It is also possible to add a carrier to the developing agent of the present invention so as to use the developing agent as a two-component developing agent.

It is desirable for the carrier particle to have an average particle diameter of 10 to 100 μm. The material of the carrier is not particularly limited. It is possible to use various soft magnetic materials as a carrier in the present invention. Also, ferrite of any desired composition such as Mn—Mg, Cu—Zn and Ni—Zn ferrite can be used in the present invention. It is desirable for the carrier used in the present invention to have a particle diameter of 10 to 100 μm.

It is possible to use in the present invention styrene polymer, copolymer of a styrene derivative and an acrylic resin as a binder resin. Preferably, styrene-acryl copolymer and styrene-butadiene copolymer can be used as the binder resin.

It is desirable for the magnetic toner particle to contain a charge control agent. The charge control agent used in the present invention, which includes, for example, a metal complex of an azo dye and nigrosine coloring matter, serves to improve the life properties of the developing agent.

Also, it is possible for the toner particle to contain further a black coloring agent.

Also, it is possible to use 0.5 to 5 parts by weight of waxes such as low molecular weight polypropylene, low molecular weight polyethylene, liquid paraffin, acid amide, a stearic acid wax, montan wax, sazol wax, castor wax, chlorinated paraffin, and carnauba wax as far as the color reproducibility is not adversely affected.

A silica particle can also be used as another additive that can be mixed with the toner particle. It is desirable for the silica particle to have an average particle diameter of about 4 to 50 nm. Also, the silica particle should desirably be added in an amount of about 0.1 to 5% by weight based on the total weight of the magnetic toner particle. The silica particle used in the present invention includes, for example, silicon dioxide, aluminum silicate, sodium silicate, zinc silicate and magnesium silicate.

In addition to the silica fine particles, it is possible to use metal oxide fine particles, cleaning assistants, etc. The metal oxide fine particles used in the present invention include, for example, fine particles of zinc oxide, titanium oxide, aluminum oxide, zirconium oxide, strontium titanate, barium titanate and zinc stearate. The cleaning assistants used in the present invention include fine powder of resins such as polymethyl methacrylate, polyvinylidene fluoride, and polytetrafluoroethylene. The cleaning assistant is added as desired in an amount of 1 to 3% by weight based on the weight of the toner particle. It is desirable to apply a surface treatment such as a hydrophobic treatment to these additives when these additives are used in the present invention.

The toner particles used in the present invention can be prepared by, for example, a wet dispersion method using a high speed dissolver, a roll mill, a ball mill, etc. as a mixing-dispersing means or by melt kneading method using a roll, a pressurizing coder, an internal mixer, a screw type extruder, etc.

Also, it is possible to use a ball mill, a V-shaped mixer, a Forverge, a Henschel mixer, etc. as a preliminary mixing means.

As a means for roughly pulverizing a mixture of the toner particle raw materials, it is possible to use, for example, a hammer mill, a cutter mill, a roller mill and a ball mill.

On the other hand, as a means for finely pulverizing the roughly pulverized material, it is possible to use, for example, a jet mill and a high speed rotating pulverizer.

Further, as a means for classifying the finely pulverized material, it is possible to use, for example, an air stream type classifying device.

For adding the second magnetic powder and the other additives to the resultant toner particle, it is possible to use a high speed rotating mixer such as a Henschel mixer. The additives can be put in the mixer together or separately depending on the kind of the additive. In short, the second magnetic powder and the other additives can be mixed under the most effective conditions.

The developing agent described above is used in the image forming apparatus of the present invention. The image forming apparatus comprises at least one image carrier. A developing device, a transfer device and a cleaning device are arranged to face the image carrier in the order mentioned. The image forming apparatus of the present invention further comprises a fixing device arranged below the transfer device. Further, the developing agent used in the present invention comprises a first magnetic powder, a toner particle containing a stearate particle having an average particle diameter of 1 to 5 μm and a binder resin, and a toner having a second magnetic powder.

Further, the image forming method of the present invention comprises the steps of supplying a developing agent onto a developing roller included in the image forming apparatus described above, said developing roller including a hollow cylindrical sleeve arranged to face the image carrier and rotated in synchronism with the image carrier and a magnet roll having a plurality of magnetic poles and rotated independently of the sleeve, so as to develop the electrostatic latent image formed on the image carrier, thereby forming a developing agent image, transferring the developing agent image onto a transfer material, and fixing the transferred developing agent image. The developing agent used in the image forming method of the present invention comprises a toner particle containing a first magnetic powder and a binder resin, a second magnetic powder, and a stearate particle having an average particle diameter of 1 to 5 μm.

The present invention will now be described in detail with reference to the accompanying drawing. Specifically, the accompanying Figure schematically shows the construction of an image forming apparatus according to one embodiment of the present invention. As shown in the Figure, the image forming apparatus of the present invention comprises a photoreceptor drum 1 acting as an image carrier. A developing device 14, a transfer device 7, a cleaning device 8, a charging device 11 and a fixing device 11 are arranged in the order mentioned to face the photoreceptor drum 1. The fixing device 11 comprises a pair of fixing rollers 9 and 10 arranged rearward of the transfer device 7 in respect of the rotating direction of the photoreceptor drum 1.

The photoreceptor drum 1 bearing an electrostatic latent image on the surface is rotated in the direction denoted by an arrow. The surface of the photoreceptor drum 1 has a resistance to scratching such that the scratch depth when a load of 160 g is applied to a sapphire needle having a needle curvature of 3 mm in a scratch test is 0.1 to 5 $\mu$m. The developing device 14 arranged to face the photoreceptor drum 1 comprises a developing agent housing section 6 formed integral with an enclosure to which a toner cartridge can be mounted. A developing agent 13 of the present invention containing a toner particle 16 and a carrier 15 is housed in the developing agent housing section 6. A developing roller 12 arranged in a lower portion of the developing agent housing section 6 is positioned to face the photoreceptor drum 1. The developing roller 12 comprises a hollow cylindrical developing sleeve 2. made of a non-magnetic material and a magnet roller 3 having a plurality of magnetic poles extending in the axial direction and arranged within the developing sleeve 2. The magnetic roller 3 is arranged coaxial with the developing sleeve 2, and these magnetic roller 3 and developing sleeve 2 are rotatable relative to each other. In the developing apparatus shown in the drawing, the developing sleeve 2 is rotated in the counterclockwise direction and the magnet roller 3 is rotated in the clockwise direction. As a result, the rotating direction of the developing agent about its own axis is equal to the transfer direction of the developing agent. It follows that the transfer amount of the developing agent can be increased so as to perform the development at a high speed. The developing agent 13 is stirred by a stirrer 5 so as to prevent the developing agent 13 from being agglomerated. At the same time, the stirrer 5 serves to transfer the developing agent 13 toward the developing roller 12.

It should be noted that the gap between the photoreceptor drum 1 and the developing sleeve 2 is 0.35 mm. Also, the gap between a developing agent regulating blade 4 and the developing sleeve 2 is 0.30 mm.

The magnetic toner is stirred and transferred by the stirrer 5 so as to be supplied to a magnetic sucking region A of the developing agent. The magnetic toner magnetically sucked in the magnetic sucking region A of the developing agent is sucked on the developing sleeve 2. At the same time, the magnetic carrier 15 is rotated and stirred together with the toner 16 in accordance with rotation of the magnet roller 3 so as to achieve charging.

A ratio of the toner weight to the weight of the developing agent on the developing sleeve 2, i.e., the specific concentration of the toner, is hovered at about 50% and, thus, the toner amount is large relative to the magnetic carrier, compared with the conventional magnet fixing type two-component developing system. Further, when it comes to the range of change in the toner concentration, inconveniences such as the toner attachment and decrease in the concentration tend to take place in the conventional magnet fixing developing system unless the specific concentration of the toner is changed within a range of ±1% by weight, making it necessary to control strictly the specific concentration of the toner. When it comes to the magnet rotation developing system, however, inconveniences of image do not take place even if the specific concentration of the toner is changed within a range of ±20%. The developing agent transferred on the sleeve 2 passes through the developing agent regulating blade 4 to form a developing agent layer of a regulated thickness so as to develop the electrostatic latent image formed on the photoreceptor drum 1.

The present invention will now be described more in detail with reference Examples of the present invention.

EXAMPLE 1

Magnetic toner material of the composition given below was prepared first:

Binder resin:

| | |
|---|---|
| Styrene-acryl copolymer | 45% by weight |
| Iron series magnetic powder | 55% by weight |
| Charge control agent | 5% by weight |

The material of the composition given above was mixed by a Henschel mixer, followed by kneading in a heat melting kneader. The resultant mixture was roughly cooled and, then, roughly pulverized in a hammer mill. Then, the roughly pulverized mixture was finely pulverized in a jet impact mill. Further, the resultant particles were applied to a wind classifier so as to remove the excessively finely pulverized particles, thereby obtaining magnetic toner particles.

4 kg of the magnetic toner particles thus obtained were put in a PVC bag together with 0.5% by weight Of silica R972 manufactured by Japan Aerosil Inc., 2% by weight of an iron series magnetic powder and 0.1% by weight of zinc stearate, and the entire bag was manually shaken so as to carry out a preliminary stirring. Then, the resultant mixture was put in a Henschel mixer and stirred for 5 minutes at the rotating speed of, for example, 1500 rpm with the lid of the Henschel mixture closed. Finally, the stirred mixture was sieved so as to obtain a toner.

A developing agent was prepared by mixing the resultant toner with a carrier, and the developing agent thus prepared was applied to TF-631, i.e., a facsimile machine of a 1.5 component developing system manufactured by Toshiba Tech Inc., so as to perform an image formation. In this case, the addition amount of an $Fe_2O_3$ carrier was adjusted to set the specific concentration of the toner at about 50% in the developing region.

The developing agent and the resultant image were tested and evaluated as follows. Table 1 shows the results.

1) Image Density Test

The image density was measured by using Mcbeth RD-914. The mark "○" in Table 1 denotes that the image density (ID) was not lower than 1.2. On the other hand, the mark (x) denotes that the image density was less than 1.2.

2) Resolution

A group of lines were printed and visually observed with a 10× magnifier to see whether each line would be recognized as an independent line. The mark "○" in Table 1 denotes that it was possible to recognize each line. Also, the mark "x" denotes that it was impossible to recognize each line.

3) Fogging

The reflectance before feeding of a paper sheet was measured by CM-503c (trade name of a spectral calorimeter manufactured by Minolta Inc.), followed by measuring the reflectance in the non-developed portion of the paper sheet after image formation thereon. The fogging was evaluated from the difference in the reflectance before and after feeding of the paper sheet. The mark "○" in Table 1 denotes that the difference in reflectance was not larger than 2.0. On the other hand, the mark "x" denotes that the difference in reflectance exceeded 2.0.

4) Blurring of Image

Character images were formed, and it was judged visually whether or not each character image was blurred. The mark "○" in Table 1 denotes that the character image was not blurred. On the other hand, the mark "x" denotes that the character image was blurred.

5) Cleaning Properties

After the blade cleaning, it was visually judged whether or not the toner and the additives passed through the blade to cause memory occurrence on the image. The mark "○" in Table 1 denotes that the memory was not recognized. On the other hand, the mark "x" denotes that the memory was recognized.

6) Life Characteristics

The film scraping amount of the photoreceptor per K rotations of the photoreceptor was measured by a paper feeding test. The mark "x" in Table 1 denotes that the film scraping amount was not smaller than 25 nm/K rotations and not larger than 13 nm/K rotations. On the other hand, the mark "○" denotes that the film scraping amount was 13 to 25 nm/K rotations.

7) Toner Flowability

A powder tester manufactured by Hosokawa Micron Inc. was used for the test. Specifically, three sieves sized 60 meshes, 100 meshes and 200 meshes were superposed one upon the other and 20 g of the toner was disposed on the top sieve. The superposed sieves were vibrated for 30 seconds. The mark "○" in Table 1 denotes that the total residual amount of the toner on the sieve was not larger than 17 g. On the other hand, the mark "x" denotes that the total residual amount on the sieve was larger than 17 g.

8) Residual Amount in the Cartridge

A toner dropping test was conducted by using a compulsory cartridge stirring tool. The toner was loaded in the cartridge in an amount of 300 g. The mark "x" in Table 1 denotes that the amount of the residual toner within the cartridge was not smaller than 25 g. On the other hand, the mark "○" denotes that the amount of the residual toner was smaller than 25 g.

9) Manufacturing Properties (Sieving)

The flowability of the toner after the external addition was measured as in test 7). The mark "○" in Table 1 denotes that the residual amount of the toner on the sieve was not larger than 17 g. On the other hand, the mark "x" denotes that the residual amount of the toner was larger than 17 g. Examples 2, 3 and Comparative Examples 1 to 5:

Developing agents were prepared and the evaluation tests were conducted as in Example 1, except that the particle diameter and addition amount of zinc stearate and the addition amount of the second magnetic powder were changed as shown in Table 1.

TABLE 1

| | | | Additives | | | |
|---|---|---|---|---|---|---|
| | | Amount of first magnetic power (%) | Particle diameter of zinc stearate (μm) | Amount of zinc stearate (%) | Addition amount of second magnetic (%) | Silica Addition amount (%) |
| Examples | 1 | 55 | 3 | 0.1 | 2 | 0.5 |
| | 2 | 55 | 3 | 0.1 | 4 | 0.5 |
| | 3 | 55 | 1 | 0.1 | 2 | 0.5 |
| Comparative Examples | 1 | 55 | 3 | 0.1 | 0 | 0.5 |
| | 2 | 55 | 3 | 0.1 | 7 | 0.5 |
| | 3 | 55 | 7 | 0.1 | 2 | 0.5 |
| | 4 | 55 | 0 | 0 | 2 | 0.5 |
| | 5 | 55 | 3 | 2 | 2 | 0.5 |

| | | Life image characteristics | | | | | | Physical properties | | |
|---|---|---|---|---|---|---|---|---|---|---|
| | | ID | Resolution | Fogging | Image blurring | Cleaning properties | Life properties | Flowability | Residual amount in cartridge | Manufacturing properties (sieving) |
| Examples | 1 | ○ | ○ | ○ | ○ | ○ | ○ | ○ | ○ | ○ |
| | 2 | ○ | ○ | ○ | ○ | ○ | ○ | ○ | ○ | ○ |
| | 3 | ○ | x | ○ | ○ | ○ | ○ | ○ | ○ | ○ |
| Comparative Examples | 1 | x | x | ○ | x | ○ | ○ | ○ | ○ | ○ |
| | 2 | ○ | ○ | ○ | ○ | x | x | x | x | x |
| | 3 | ○ | ○ | x | Δ | (x) | Δ | Δ | Δ | Δ |
| | 4 | ○ | ○ | ○ | ○ | (x) | x | ○ | ○ | ○ |
| | 5 | ○ | ○ | x | Δ | ○ | Δ | x | x | x |

As apparent from Table 1, the present invention makes it possible to improve the properties of the developing agent and the developing agent of the present invention permits improving the image characteristics.

However, if, for example, the second magnetic powder is not added, the image carrier is not scraped appropriately so as to bring about decrease in the image density and the resolution, as apparent from Comparative Example 1. Also, the developing agent image was blurred and the life characteristics were rendered poor.

Also, if the average particle diameter of the stearate exceeds 5 $\mu$m as in Comparative Example 3, the cleaning properties were rendered poor so as to bring about fogging. Fogging was also recognized in the case where the addition amount of the stearate exceeded 0.5% by weight, as apparent from Comparative Example 5.

If the addition amount of the second magnetic powder exceeds 5% by weight, the cleaning properties are rendered poor, as apparent from Comparative Example 2.

Also, if the stearate is not added, the film scraping amount of the image carrier is increased, and the life characteristics are rendered poor, as apparent from Comparative Example 4.

Further, if the addition amount of the second magnetic powder exceeds 5% by weight, the toner flowability is rendered poor, as apparent from Comparative Example 2. Still further, if the amount of the stearate exceeds 0.5% by weight, the flowability of the toner is rendered poor, as apparent from Comparative Example 5.

What is claimed is:

1. A developing agent comprising toner particles containing a first magnetic powder and a binder resin, 0.5 to 5% by weight based on the total weight of the toner particles of a second magnetic powder, and 0.01 to 0.5% by weight based on the total weight of the toner particles of stearate particles having an average particle diameter of 1 $\mu$m to 3 $\mu$m.

2. The developing agent according to claim 1, further comprising a carrier.

3. The developing agent according to claim 1, wherein said first magnetic powder is contained in an amount of 40 to 65% by weight based on the total weight of the toner particle.

4. The developing agent according to claim 1, wherein said second magnetic powder is contained in an amount of 0.5 to 5% by weight based on the total weight of the toner particle.

5. The developing agent according to claim 1, wherein said stearate particle is contained in an amount of 0.05 to 0.2% by weight based on the total weight of the toner particle.

6. The developing agent according to claim 1, wherein the weight ratio of the toner to the weight of the developing agent falls within a range of between 20 and 70% by weight.

7. An image forming method, comprising the steps of:

supplying a developing agent containing toner particles having a first magnetic powder and a binder, 0.5 to 5% by weight based on the total weight of the toner particles of a second magnetic powder and 0.01 to 0.5% based on the total weight of the toner particles of stearate particles having an average particle diameter of 1 $\mu$m to 3 $\mu$m onto a developing roller arranged to face an image carrier and having a hollow cylindrical sleeve rotatable in synchronism with the image carrier and a magnet roll having a plurality of magnetic poles and rotated independently of the sleeve so as to develop an electrostatic latent image formed on the image carrier to form a developing agent image;

transferring the developing agent image onto a transfer material; and fixing the transferred developing agent image.

8. The image forming method according to claim 7, further comprising a carrier.

9. The image forming method according to claim 7, wherein said first magnetic powder is contained in an amount of 40 to 65% by weight based on the total weight of the toner particle.

10. The image forming method according to claim 7, wherein said,second magnetic powder is contained in an amount of 0.5 to 5% by weight based on the total weight of the toner particle.

11. The image forming method according to claim 7, wherein said stearate particle is contained in an amount of 0.05 to 0.2% by weight based on the total weight of the toner particle.

12. The image forming method according to claim 7, wherein the weight ratio of the toner to the total weight of the developing agent falls within a range of between 20 and 70% by weight.

* * * * *